US005839621A

United States Patent [19]

Tada

[11] Patent Number: 5,839,621

[45] Date of Patent: Nov. 24, 1998

[54] PUMP DISPENSER

[75] Inventor: Tetsuya Tada, Tokyo, Japan

[73] Assignee: Mistlon Technology B.V., Rotterdam, Netherlands

[21] Appl. No.: 845,172

[22] Filed: Apr. 25, 1997

[30] Foreign Application Priority Data

Apr. 26, 1996 [JP] Japan ..... 8-131191

[51] Int. Cl.[6] ..... B67D 5/40; B05B 9/043

[52] U.S. Cl. ..... 222/383.1; 222/384; 222/153.13; 222/324.8; 239/333

[58] Field of Search ..... 222/153.13, 383.1, 222/384, 321.8; 239/333

[56] References Cited

U.S. PATENT DOCUMENTS

| | | | |
|---|---|---|---|
| 3,173,584 | 3/1965 | Giavasis | 222/324 |
| 4,105,145 | 8/1978 | Capra | 222/383.1 |
| 4,593,607 | 6/1986 | Bennett | 222/383.1 |
| 4,767,033 | 8/1988 | Gemperle | 239/333 |
| 4,815,632 | 3/1989 | Ball et al. | 222/383.1 |
| 4,940,186 | 7/1990 | Tada | 222/383.1 |
| 5,014,884 | 5/1991 | Wunsch | 239/333 |
| 5,156,304 | 10/1992 | Battegazzore . | |
| 5,667,138 | 9/1997 | Crampton | 239/333 |

FOREIGN PATENT DOCUMENTS

| | | |
|---|---|---|
| 0 097 094 | 6/1983 | European Pat. Off. . |
| 2430269 | 1/1997 | France . |
| 37 06 963 | 3/1987 | Germany . |
| 44 01 453 | 1/1994 | Germany . |

*Primary Examiner*—Andres Kashnikow
*Assistant Examiner*—Keats Quinalty
*Attorney, Agent, or Firm*—Andrus, Sceales, Starke & Sawall

[57] ABSTRACT

A cylinder 12 is positioned along the vertical axis. A piston 16 and a trigger 18 are provided respectively with a pair of racks 40 capable of meshing with a pair of pinions 38 of a housing 14. By way of the pinion pair 38, pivoting motion of the trigger can be converted into a reciprocating movement of the piston along the vertical axis. It is thus possible to increase the amount of discharge of liquid in one stroke of the trigger without inducing for example a drop in operability upon molding.

4 Claims, 6 Drawing Sheets

PUMP DISPENSER

BACKGROUND OF THE INVENTION

1. Field of the Invention

The present invention relates to a pump dispenser in which reciprocating movement of a piston interlocking with pivoting motion of a trigger pumps liquid within a container into a cylinder and compress it therein, the thus compressed liquid being discharged from an orifice at the extremity of an outflow passage.

2. Description of the Related Art

In view of an environmental problem of destruction of the ozone layer by Freon, a particular attention is recently being paid to a pump dispenser designed to compress and discharge the liquid by reciprocating movement of the piston interlocking with pivoting motion of the trigger without using Freon.

Well known as the pump dispenser of this type is one disclosed in for example U.S. Pat. No. 4,815,663. This pump dispenser is formed with a trigger capable of being freely pulled (pivoted) against a biasing force of a return spring, and with a piston reciprocable within the cylinder and coupled to the trigger in an interlocking manner. As a result of reciprocating movement of the piston attendant on pivoting motion of the trigger, the liquid within the container is pumped into the cylinder and compressed therein, the thus compressed liquid being discharged from an orifice (discharge port). This pump dispenser of a so-called trigger type is thus constructed.

In the trigger type pump dispenser, the trigger can pivot back and forth on a support and hence the cylinder is so positioned as to extend for example in the horizontal direction or an inclined direction in order to ensure that the reciprocating movement of the piston results in a back and forth movement interlocking with the pivoting motion of the trigger.

This type of pump dispenser can increase the amount of discharge of the liquid in one stroke of the trigger by securing a larger range of movement of the piston relative to the cylinder. However, in the known pump dispenser, the cylinder extends in the horizontal direction or inclined direction, inevitably leading to an increase in dimension of the pump dispenser in its longitudinal direction arising from the elongation of the effective length of the cylinder, in other words, an increase in size of the pump dispenser.

As an alternative, the diameter of the cylinder may be enlarged to increase the amount of discharge in the same stroke. In this configuration, however, the dimensions of the pump dispenser are inevitably increased in the directions of height and width thereof due to enlarged diameter of the cylinder although an increase in longitudinal dimension of the pump dispenser is prevented.

A push type pump dispenser is also known which has a cylinder orientated along the direction in which the liquid is pumped up (U.S. Pat. No. 3,062,416, and others). This push type pump dispenser is provided with a nozzle head vertically movable together with the piston, and the pushing and projecting action of the nozzle head causes a reciprocating movement of the piston within the cylinder along the liquid pumping direction, that is, the vertical direction, thereby enabling the liquid to be pumped up and compressed.

Thus, the orientation of the cylinder along the vertical direction will allow the cylinder to be accommodated within the container when the dispenser is mounted to the container, thereby preventing the pump dispenser from increasing in size due to the increased bulk of the portion exposed from the container.

In such a push type pump dispenser, however, the nozzle head is pushed in with a finger or the like and therefore a longer stroke would prevent a smooth pushing operation. Consequently, a great deal of operating force is required for pushing, inevitably resulting in lowering of the operativity.

U.S. Pat. No. 5,156,304 for example discloses a configuration in which pivoting motion of the trigger can be converted into rising and lowering movement of the piston in the vertical direction. In this configuration, a pivoting lever is provided in such a manner as to be able to interlock with the trigger, and the pivoting motion of the pivoting lever interlocked with the trigger and the downward pressing of a delivery head under this pivoting motion enables the delivery head to lower in the vertical direction.

By the way, in this configuration, the pivoting lever and the delivery head have different moving trajectories, so that a difference between the two moving trajectories is compensated for by sliding action of the pivoting lever on the top surface of the delivery head. However, in order to allow the pivoting lever to slide on the top surface of the delivery head in this manner, the surface accuracy must be heightened at the portion in which the two elements abut against each other. Otherwise, the frictional resistance or the like may possibly impede the smooth action of the trigger and the piston.

Such heightening of the surface accuracy may often make the molding operation of the elements complicated, imperatively lowering the operativity for the molding.

SUMMARY OF THE INVENTION

It is therefore the object of the present invention to provide a pump dispenser capable of increasing the amount of discharge of liquid in one stroke of the trigger without inducing for example a drop in operability upon molding.

According to an aspect of the present invention, in order to achieve the object, the cylinder is positioned on a vertical axis along the direction in which the liquid is pumped, the piston being substantially L-shaped including a vertical flow passage and a horizontal flow passage continuous with the vertical flow passage and serving as an outflow passage of the liquid, the piston having at a lower end of the vertical flow passage a skirt-like sealing piece integrally formed therewith and capable of being in sliding contact with the inner surface of the cylinder, the piston being arranged and supported in such a manner as to be vertically movable in the direction of axis corresponding thereto.

The housing is fixedly arranged on the upper portion of the cylinder and rotatably supporting a pair of pinions capable of meshing with a pair of racks formed integrally along the vertical flow passage of the piston; the trigger having a pair of sector gears formed integrally therewith and capable of meshing with the pair of pinions, the upper end of the trigger being pivoted to the housing at the associated position.

The pivoting motion of the trigger is capable of being converted into a reciprocating movement of the piston on a vertical axis along the axis of the cylinder, by way of rotation of the pair of pinions interlocking with the pivotal motion of the trigger, and further rectilinear movement of the pair of racks in the vertical direction attendant on the rotation of the pair of pinions.

BRIEF DESCRIPTION OF THE DRAWINGS

The above and other objects, aspects, features and advantages of the present invention will become more apparent from the following detailed description in light of the accompanying drawings in which.

DESCRIPTION OF THE PREFERRED EMBODIMENTS

Preferred embodiments of the present invention will now be described in detail with reference to the accompanying drawings.

Figure 1:
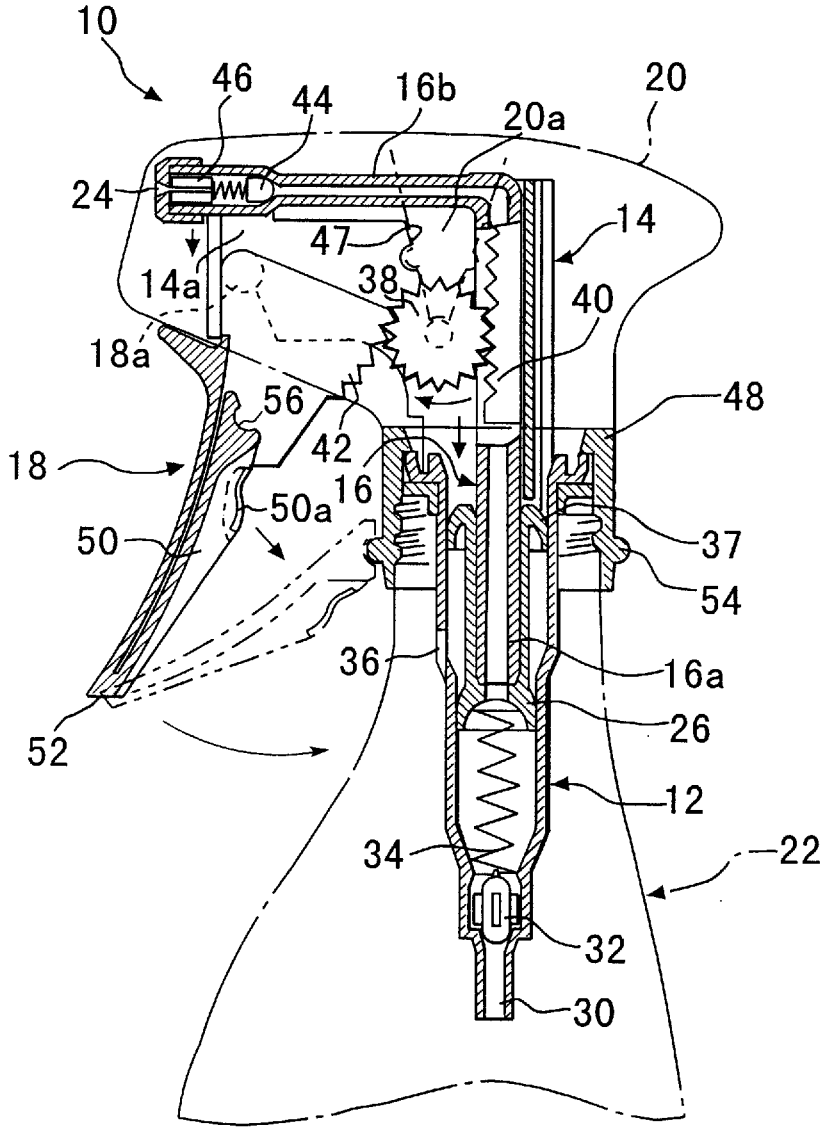
FIG. 1 is a schematic longitudinal sectional view, partly cut away, of a pump dispenser in accordance with an embodiment of the present invention.
Figure 2:
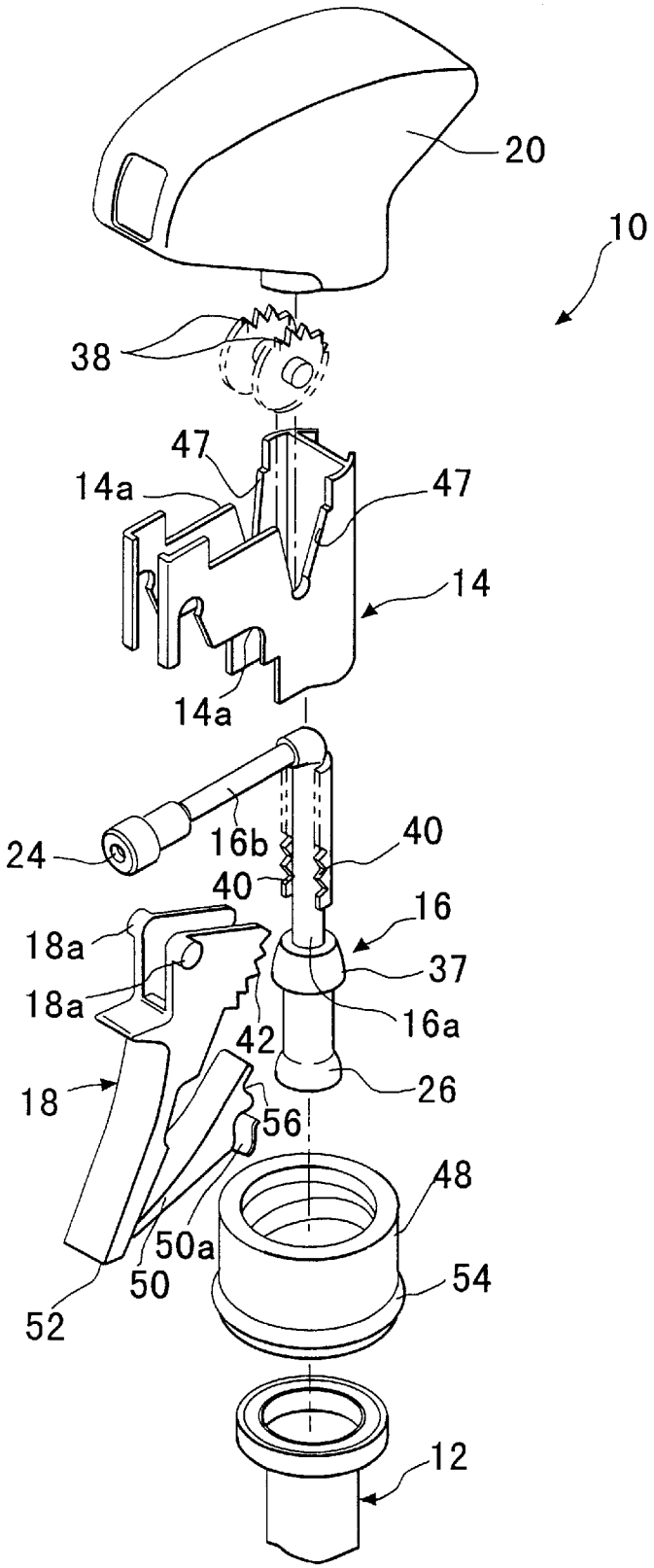
FIG. 2 is a schematic exploded perspective view, partly cut away, of the pump dispenser shown in FIG. 1.

As shown in FIGS. 1 and 2, a pump dispenser 10 in accordance with the present invention comprises a cylinder 12, a housing 14, a piston 16 and a trigger 18. The pump dispenser 10 is detachably mounted to a container 22, with a cover 20 serving to enclose the major elements. The arrangement of the pump dispenser 10 is such that a pivoting motion of the trigger 18 is converted into a rectilinear movement of the piston 16 within the cylinder 12 to reciprocate the piston within the cylinder, thereby pumping liquid within the container 22 into the cylinder and compressing it, to allow the thus compressed liquid to flow out of an orifice 24 at the extremity of an outflow passage.

The cylinder 12 molded in the form of, for example, substantially a tubular member with steps is arranged on a vertical axis along the direction of pumping the liquid and is coupled to the lower portion of the housing 14. The piston 16 has integrally at the lower end of a vertical flow passage 16*a* a skirt-like sealing piece 26 slidable on the inner surface of the cylinder 12 and is arranged and supported vertically movably relative to the cylinder and the housing 14.

The piston 16 is substantially L-shaped and has a horizontal flow passage 16*b* continuous with the upper end of the vertical flow passage 16*a* and serving as the outflow passage (nozzle) for the liquid. The vertical flow passage 16*a* having the skirt-like sealing piece 26 fastened to the lower end thereof by fitting or the like is slidably inserted into the cylinder 12, to enable the piston 16 to move along the axis of the cylinder, that is, to rise and lower.

It is to be noted that although the flow passages of the piston are herein embodied as the vertical flow passage 16*a* and the horizontal flow passage 16*b*, those designations are merely for convenience's sake and hence the vertical and horizontal flow passages can include ones inclined in some degree relative to the vertical and horizontal directions, respectively.

As can be seen from FIG. 2, the housing 14 is molded into a shape allowing an insertion of the piston 16 from below and a support of the vertically movable piston with the aid of lateral holding by a pair of holding pieces 14*a*, and is fixedly coupled to the upper end of the cylinder 12 by fitting or the like.

In such a pump dispenser 10, as shown in FIG. 1, the cylinder 12 has at its lower end an inflow passage 30 for the liquid from the container 22. A primary valve 32 is disposed so as to be able to close the inflow passage 30, and the opening and closing action of the primary valve corresponding to the reciprocating motion of the piston 16 within the cylinder 12 controls the flow of the liquid between the inflow passage and the cylinder.

A compression coiled spring 34 serving as a return spring for upward biasing the piston 16 toward the cylinder 14 is interposed between the piston and the cylinder within the interior of the cylinder.

Reference numeral 36 of FIG. 1 denotes a ventilation hole (a negative pressure prevention hole) for preventing the pressure within the container from becoming negative as a result of inflow (pumping) of the liquid from the container 22 into the cylinder 12. Such a ventilation hole is formed at corresponding positions between the skirt-like sealing piece 26 and similar sealing piece 37 positioned at the upper portion of the skirt-like sealing piece, for example three positions apart 120 degrees from one another on the side wall of the cylinder.

In the present invention, as shown in FIGS. 1 and 2, a pair of pinions 38 are rotatably supported on the housing 14, with their shaft extending and being supported between the pair of holding pieces 14*a*. A pair of racks 40 capable of meshing with the pair of pinions are formed integrally along the vertical passage 16*a* of the piston. As shown in FIG. 2, the pinion 38 pair and rack 40 pair are arranged on opposite sides of the vertical flow passage 16*a*, so that rectilinear movement of the rack pair caused by integral rotation of the pinion pair allow the piston 16 to vertically move, that is, rise and lower.

The trigger 18 is molded integrally having a pair of sector gears 42 meshing with the pair of pinions 38 and is pivotally coupled to and supported on the housing 14, with their protrusions 18*a* being loosely and pivotally fitted into the holding pieces 14*a*.

In other words, the trigger 18 is coupled to the piston 16 in an interlocking manner by way of a transmission path including a combination of the sector gear pair 42, the pinion pair 38 and the rack pair 40.

In such an arrangement, pulling of the trigger 18 causes the sector gear pair 42 to rotate in the counterclockwise direction around the protrusions 18*a*, which results in rotations of the pinion pair 38 in the corresponding direction, that is, clockwise direction. The rotation of the pinion pair 38 in turn causes a downward movement of the rack pair 40, allowing the piston 16 to lower against the biasing force of the return spring (compression coiled spring) 34.

The lowering of the piston 16 causes a downward sliding motion of the skirt-like sealing piece 26 within the interior of the cylinder 12, which in turn compresses the liquid within the cylinder. The thus compressed liquid passes through the vertical flow passage 16*a* and the horizontal flow passage 16*b* and then through a secondary valve 44 and a spinner (a vortex member) 46, and is finally discharged as for example a jet of the liquid from the orifice 24 at the extremity of the outflow passage.

When the pulling force is released at the pulling position of the trigger 18, the piston 16 is urged to rise under the biasing force of the return spring 34. The rise of the piston 16, that is, the rise of the rack pair 40 causes a counterclockwise rotation of the pinion 38, which in turn allows the trigger 18 to return its initial projecting position through a pivoting motion around the protrusions 18*a*.

As a result of an upward sliding motion of the skirt-like sealing piece 26 within the interior of the cylinder 12 attendant on the rise of the piston 16, the liquid within the container 22 is pumped through the inflow passage 30 and the primary valve 32 into the cylinder, and stands by until the subsequent pulling operation of the trigger.

The pump dispenser 10 of this type is so constructed that the discharge and pumping of the liquid is sequentially carried out through one stroke operation which is initiated by pulling the trigger 18 and terminated by releasing the pulling force.

In the pump dispenser 10 of the present invention, the major elements such as for example the cylinder 12, the piston 16, the trigger 18, the pinion pair 38, etc., excluding the cover 20 are assembled into a single unit based on the housing 14. The unit is enclosed by the cover 20 to assemble the pump dispenser.

The cover 20 is molded integrally having a vertically extending protrusion 20*a* adapted to be fitted into a notch 47 which is utilized upon the insertion of the pinion pair 38 into the housing 14. The cover 20 is attached to the housing, that is, the above-mentioned unit by fitting of this protrusion.

The pump dispenser 10 of this type is provided with an internally threaded bottle cap 48 which is threaded onto a mouth 22*a*, thereby enabling the pump dispenser 10 to be removably attached to the container 22.

In the pump dispenser 10 of the present invention, as described above, the cylinder 12 extends in the vertical direction which is the liquid pumping direction. As is apparent from FIG. 1, the positioning of the cylinder 12 on the vertical axis allows the cylinder to be inserted and accommodated in the interior of the container when the pump dispenser 10 is attached to the container 22. According to the present invention, therefore, it becomes possible to increase the effective length of the cylinder without increasing the external dimensions of the pump dispenser 10.

This means that an increase in the amount of discharge of the liquid in one stroke of the trigger 18 is achieved without increasing the dimensions of the exposed portion of the pump dispenser 10.

Dissimilar to the known construction having a cylinder extending in the direction other than the vertical direction, the cylinder 12 of the present invention does by no means deviate from the vertical axis, thereby ensuring a secure suppression of the longitudinal length of the pump dispenser 10.

In other words, the present invention makes it possible to easily secure an increase in the amount of discharge of the liquid in one stroke of the trigger 18 without a need to increase the size of the portion of the pump dispenser 10 exposed from the container 22.

The rising and lowering motion of the piston 16 relative to the cylinder 12 is derived from the pivoting action of the trigger 18, and hence sufficiently a small pivoting range is secured in spite of increase in the range of movement of the piston (the range in which the piston rises and lowers), which will alleviate the operating force.

Thus, by orientating the cylinder 12 along the vertical direction and providing the piston 16 in such a manner as to be able to rise and lower in interlock with the pivoting motion of the trigger 18, there is achieved an increase in the amount of discharge of the liquid in one stroke of the trigger 18 without increasing the dimensions of the portion of the pump dispenser 10 exposed from the container 22.

Also, since in the present invention the pivoting motion of the trigger 18 is converted into a rectilinear movement of the piston 16 by way of a transmission mechanism including a combination of the trigger sector gear pair 42, the pinion pair 38, and the piston rack pair 40, there can be easily secured a smooth interlock free from any influence of frictional resistance or the like. Accordingly, the surface accuracy of the elements is sufficiently relieved, facilitating the molding of the elements.

Thus, defective interlock among the elements can be securely prevented which may arise from the frictional resistance or the like, thereby readily securing an improvement in operating properties.

By the way, in the pump dispenser 10 of this type, the trigger 18 ordinarily lies in its projecting position as shown in FIG. 1, so that there may possibly occur unexpected outflow of the liquid due to falling down of the container 22 or pulling operation by children including infants. Therefore, as shown in FIGS. 1 and 2, a bendable stopper 50 may be provided at the lower end of the trigger 18 for restricting the pivoting motion of the trigger.

The stopper 50 is formed integrally at the lower end of the trigger 18 by way of a hinge 52 in the form of a thinned portion and is so arranged that it can turn around the hinge between a first position in which the stopper is retracted in the trigger indicated by a solid line in FIG. 1 and a second position in which the stopper is projected from the trigger indicated by a chain double-dashed line in FIG. 1.

The stopper 50 is retained in its first position, that is, the retracted position upon the fitting into the trigger 18 and can be projected from the retracted position by drawing an operation piece 50*a*.

As shown in FIGS. 1 and 2, the bottle cap 48 for example is molded having on its peripheral surface a flange-like engagement protrusion 54 which is adapted to be fitted into an recess 56 formed at the end of the stopper 50.

In such a construction, the stopper 50 is drawn and projected from the trigger 18, and the engagement protrusion 54 is engaged with the recess 56 so that the stopper is positioned and retained between the trigger and the bottom cap 48 as indicated by a chain double-dashed line in FIG. 1. By positioning and retaining the stopper 50 between the trigger 18 and the bottle cap 48 in this manner, the pivoting motion of the trigger toward the pulling direction is blocked by the presence of the stopper 50. The stopper 50 thus functions as a so-called childproof mechanism (accident prevention mechanism) providing a secure prevention of the pivoting movement of the trigger which may caused by falling down or mischief of infants or the like, thereby securely preventing unexpected accidents or the like arising from unexpected outflow of the liquid. It is to be appreciated that in the present invention such a construction will suffice that the liquid of the container 22 is discharged from the orifice 24, so that the present invention is applicable to a so-called two liquids mixing type pump dispenser 110 in which two different liquids are mixed together previous to the discharge as shown in FIGS. 3 and 4.

Figure 4:
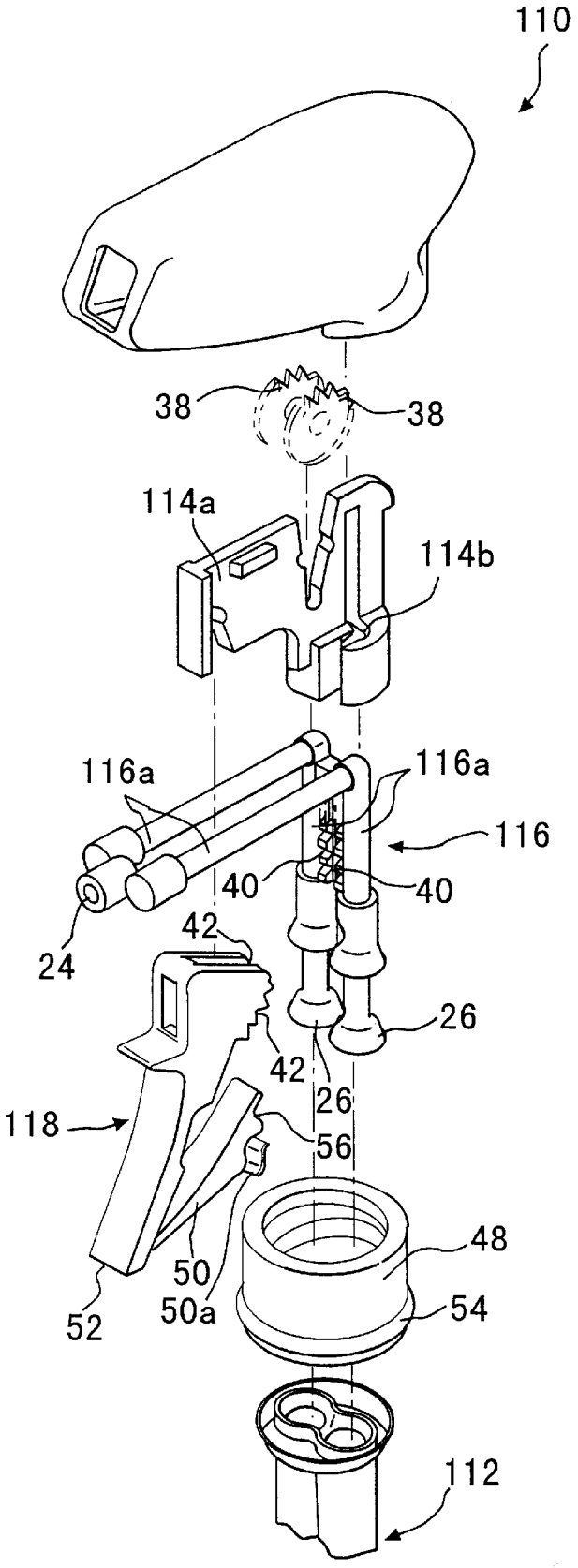
FIG. 4 is a schematic exploded perspective view, partly cut away, of the pump dispenser shown in FIG. 3.

As can be seen from FIG. 4, the pump dispenser 110 is molded having a twin configuration comprising a pair of juxtaposed cylinders 112 leading to corresponding inflow passages 30, and a pair of juxtaposed pistons 116 each having a vertical flow passage 116*a* and a horizontal flow passage 116*b* continuous with the vertical flow passage 116*a*. The pistons each having a skirt-like sealing piece 26 inserted into the associated cylinder are so arranged as to be able to rise and lower along their respective axes relative to the cylinders.

Figure 3:
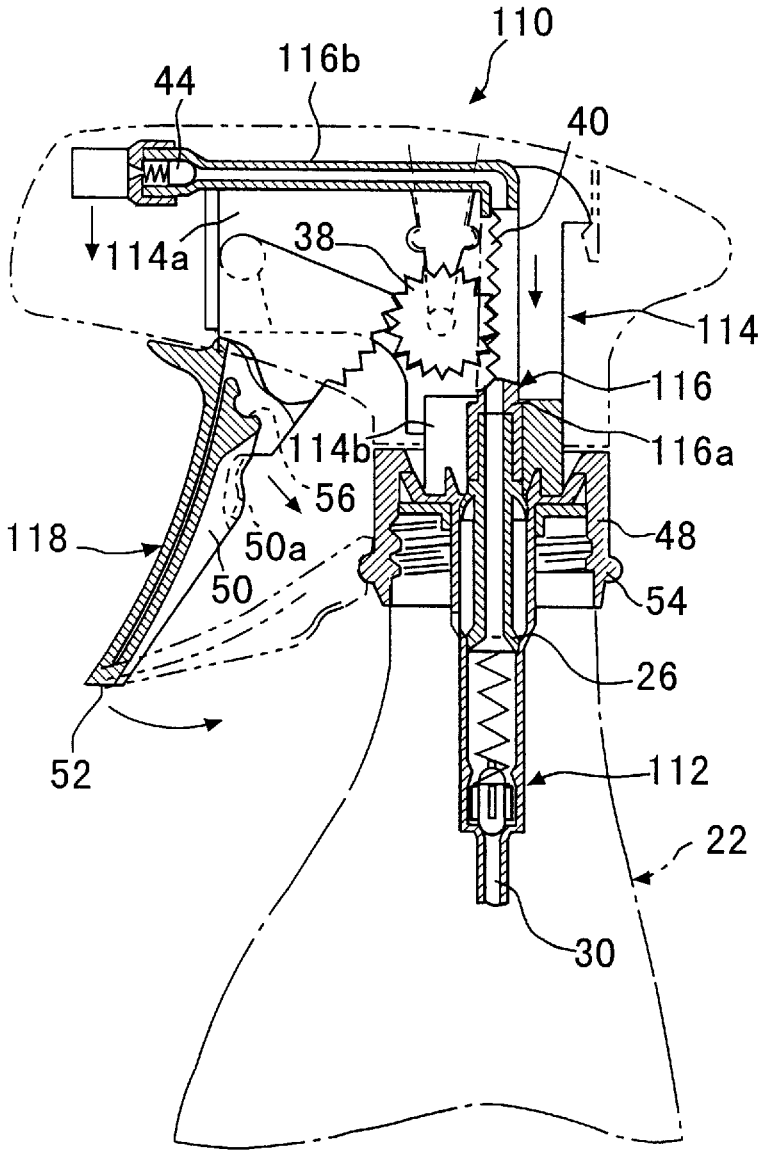
FIG. 3 is a schematic longitudinal sectional view, partly cut away, of a pump dispenser in accordance with another embodiment of the present invention.

As shown in FIGS. 3 and 4, the housing 114 is so molded as to allow an insertion of the twin pistons 116 from below and has a forward extending support piece 114*a* and a recess 114*b* at the lower end to support the twin pistons in such a manner as to be vertically movable.

In the same manner as the above embodiment, the pinion pair 38 are rotatably supported on the housing 114, and the rack pair 40 mating with the pinion pair are formed along the vertical flow passages 116*a* of the pistons. A trigger 118 has a pair of sector gears formed integrally therewith and mating with the pinion pair, and is pivoted at its upper end to the housing 114.

In this embodiment as well, the major elements such as the twin cylinders 112, the twin pistons 116, the trigger 118 and pinion pair 38 are formed into a single unit based on the housing 114. The bottle cap 48 is attached to this unit, which is then enclosed by a cover 120, to form a pump dispenser 110 mountable to the container 22.

Figure 5:
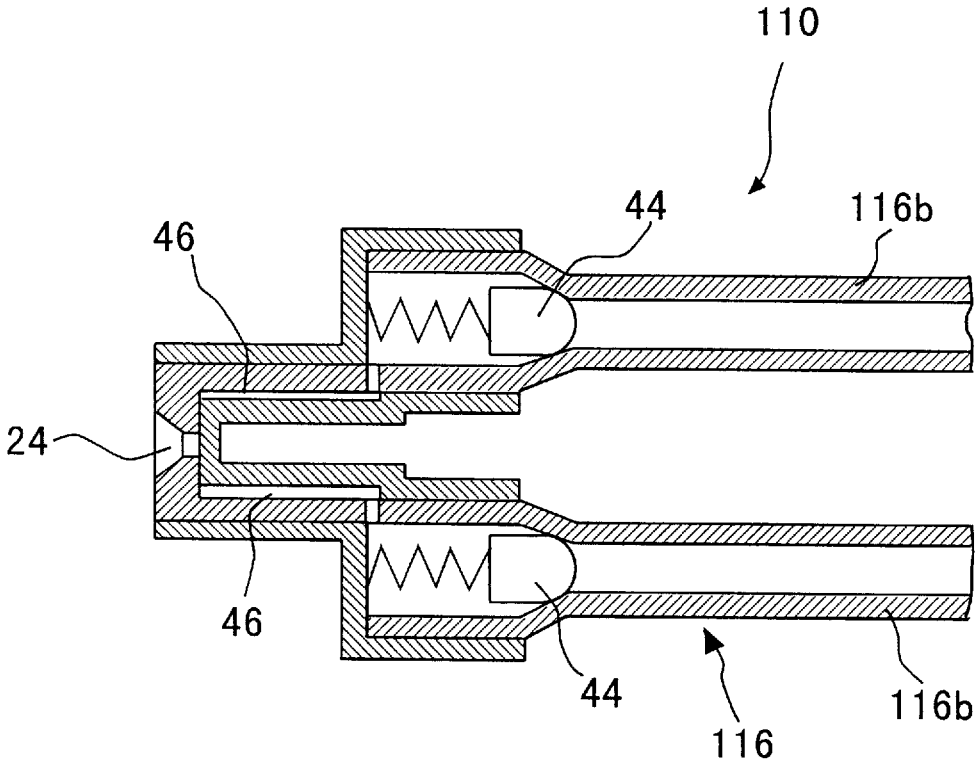
FIG. 5 is a transverse cross section of the extremity of an outflow passage of the pump dispenser shown in FIG. 3.

The construction of such a two liquids mixing type pump dispenser 110 is such that as shown in FIG. 5, the horizontal flow passage pair 116*b* of the twin pistons communicate with each other at their tips, allowing the two liquids which have been mixed through the secondary valve pair 44 and the spinner pair 46 to be discharged from the same orifice 24.

In this manner, it would suffice to orient the twin cylinders 112 along the vertical axis and pivoting motion of the trigger 118 is converted into a rectilinear movement of the rack pair 40 attendant on the rotation of the pinion pair 38, that is, a vertical movement of the twin pistons 116, so that the two liquids mixing type pump dispenser also readily provides an increased amount of discharge of the liquid in one stroke of the trigger 118 without impairing its function.

Since a vertical movement of the twin pistons 116 attendant on the pivoting motion of the trigger 118 is appropriately achieved by way of the pinion pair 38, the rack pair 40 and the sector gear pair 42, it is natural that this construction also ensure the same effect as that obtained in the above embodiment.

Figure 6:
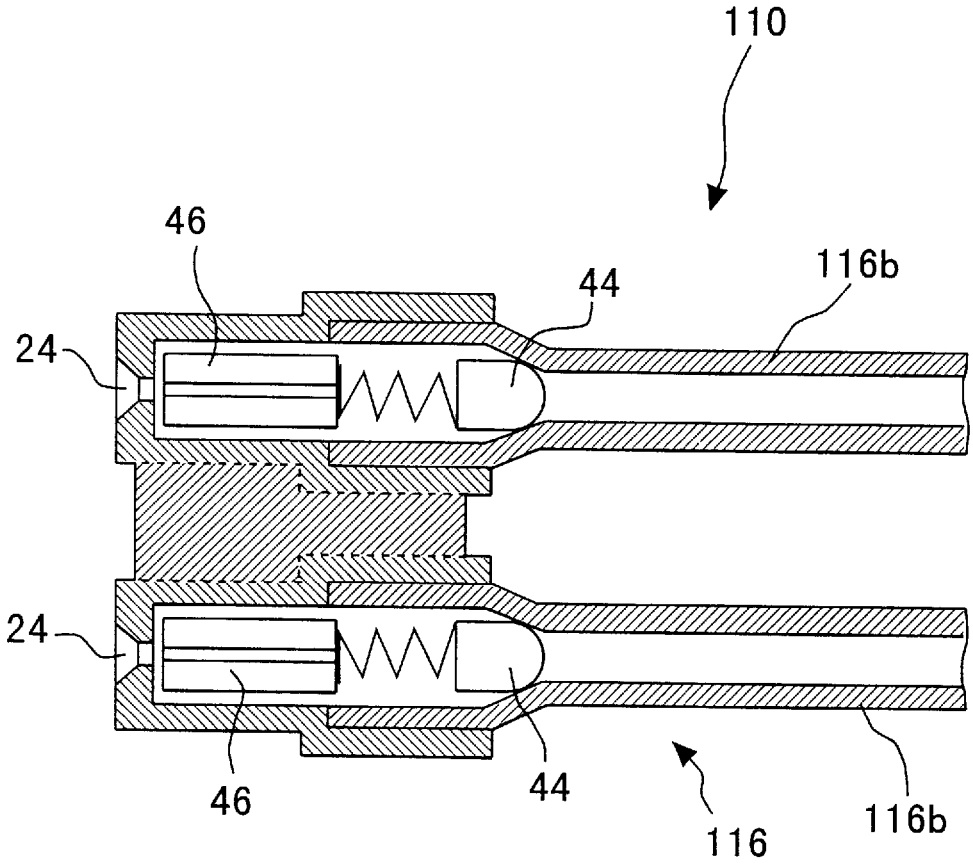
FIG. 6 is a transverse cross section similar to FIG. 5 but showing the extremity of an outflow passage of a variant.

Although in this embodiment the two different liquids are mixed together before discharge from the orifice 24 as shown in FIG. 5, the present invention is not limited to such a configuration. For example, as shown in FIG. 6, the horizontal flow passage pair 116*b* of the twin pistons may have their respective orifices so that the two different liquids are mixed together after the discharge from the associated orifices.

In this case, as shown in FIGS. 3 and 4, the trigger 118 may be provided integrally at its lower end with the bendable stopper 50 by way of the hinge 52. The stopper 50 is positioned and retained between the trigger and the bottle cap by bringing the recess 56 at the tip into engagement with the engagement protrusion 42 of the bottle cap 48, thereby naturally enabling the stopper to function as childproof means in the same manner as the above embodiment.

It will be understood that the above embodiments are illustrative purposes only and are not intended to limit the present invention, and that all the modifications and variants made without departing from the spirit and scope of the present invention are to be involved within the present invention.

According to the pump dispenser of the present invention, as set forth hereinabove, the orientation of the cylinder along the vertical direction will enable the effective length of the cylinder to be elongated without increasing the external dimensions of the pump dispenser. Moreover, the conversion of the pivoting motion of the trigger into a reciprocating movement of the piston will enable the pivoting motion to be restricted to a fairly small range irrespective of enlargement of the range of movement of the piston (the range in which the piston rises and lowers), thus alleviating the operating force.

Accordingly, an increase in the amount of discharge of the liquid in one stroke is achieved without causing any increase in the size of the portion exposed from the container and therefore the lowering of the operativity.

Furthermore, by virtue of the conversion of the pivoting motion of the trigger into the reciprocating movement of the piston along the vertical axis by way of a combination of the pinion pair, rack pair and sector gear pair, a smooth interlocking free from the influence of the frictional resistance or the like can be readily secured with the relieved surface accuracy and easy molding of the elements.

The present invention is readily applicable to the two liquids mixing type pump dispenser since it would suffice to position the cylinder on the vertical axis and to be able to convert the pivoting motion of the trigger into the reciprocating movement of the piston along the vertical axis by way of the combination of the pinion pair, rack pair and the sector gear pair.

Furthermore, a stopper provided at the lower end of the trigger may be positioned and retained between the trigger and the bottom cap in order to cause the stopper to function as the childproof mechanism, thereby achieving a secure prevention of unexpected accidents or the like which may arise from unexpected outflow of the liquid.

What is claimed is:

1. A pump dispenser comprising a housing, a bottle cap fitted to a mouth of a container, an inflow passage of liquid, a cylinder continuous with the inflow passage, a trigger, a piston capable of reciprocating within the cylinder in interlocking with pivoting motion of the trigger, for pumping and compressing the liquid, and an outflow passage having at its extremity an orifice through which the compressed liquid is discharged; wherein said cylinder is positioned on a vertical axis along the direction in which the liquid is pumped, said piston being substantially L-shaped including a vertical flow passage and a horizontal flow passage continuous with the vertical flow passage and serving as an outflow passage of the liquid, said piston having at a lower end of the vertical flow passage a skirt-like sealing piece integrally formed therewith and capable of being in sliding contact with the inner surface of the cylinder, said piston being arranged and supported in such a manner as to be vertically movable in the direction of axis corresponding thereto; and wherein said housing is fixedly arranged on the upper portion of the cylinder and rotatably supporting a pair of pinions capable of meshing with a pair of racks formed integrally along the vertical flow passage of the piston; said trigger having a pair of sector gears formed integrally therewith and capable of meshing with the pair of pinions, the upper end of the trigger being pivoted to the housing at the associated position; and wherein the pivoting motion of the trigger is capable of being converted into a reciprocating movement of the piston on a vertical axis along the axis of the cylinder, by way of rotation of the pair of pinions interlocking with the pivotal motion of the trigger, and further rectilinear movement of the pair of racks in the vertical direction is attendant on the rotation of the pair of pinions.

2. A pump dispenser according to claim 1, wherein said cylinder and piston have a twin configuration consisting of a pair of right and left parts formed integrally with each other, and wherein said right and left parts of the piston are integrally movable in the vertical direction relative to said right and left parts of the cylinder, by way of rotation of the pair of pinions interlocking with the pivotal motion of the trigger, and further rectilinear movement of the pair of racks is attendant on the rotation of the pair of pinions.

3. A pump dispenser according to claim 2, wherein said right and left parts of the cylinder have their respective horizontal flow passages whose extremities communicate with each other for allowing a discharge from the same orifice.

4. A pump dispenser according to claim 1, further comprising:

a stopper formed integrally at the lower end of the trigger by way of a hinge in the form of a thinned portion, said stopper being capable of being retracted and retained within the interior of the trigger by bending at the hinge, wherein said bottle cap has an engagement protrusion, with the stopper having at its free end an engagement recess which mates with the engagement protrusion, so as to allow the stopper to be positioned and retained between the trigger and the bottle, thereby making it possible to block the pivoting motion of the trigger toward the pulling direction.

* * * * *